US006623316B1

(12) United States Patent
Wu

(10) Patent No.: US 6,623,316 B1
(45) Date of Patent: Sep. 23, 2003

(54) ELECTRICAL CONNECTOR HAVING IMPROVED FEATURES REGARDING NORMAL FORCE REQUIRED FOR EFFECTIVELY ENGAGING A PRINTED BOARD WITH THE ELECTRICAL CONNECTOR

(75) Inventor: Jerry Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/119,628

(22) Filed: Apr. 9, 2002

(51) Int. Cl.[7] ..... H01R 4/48

(52) U.S. Cl. ..... 439/862; 439/79; 439/630; 439/188

(58) Field of Search ..... 439/65, 188, 79, 439/59, 289, 824, 630, 862, 66; 200/51.04, 51.09, 629

(56) References Cited

U.S. PATENT DOCUMENTS 4,142,226 A * 2/1979 Mears ..... 439/59
5,259,777 A * 11/1993 Schuder et al. ..... 439/188
5,879,169 A * 3/1999 Wu ..... 439/74
6,406,305 B1 * 6/2002 Wu ..... 439/65
6,409,529 B1 * 6/2002 Liu et al. ..... 439/188
6,435,887 B2 * 8/2002 Koitsalu ..... 439/188

* cited by examiner

*Primary Examiner*—Renee Luebke
*Assistant Examiner*—Felix O. Figueroa
(74) *Attorney, Agent, or Firm*—Wei Te Chung

(57) ABSTRACT

An electrical connector (1) includes an insulative housing (10), a plurality of main contacts (12) and assistant contacts (14). The insulative housing defines a lateral wall (20), a plurality of sidewalls (22) extending from the lateral wall and a plurality of cavities (24) formed therebetween. Each of the main contacts has a retaining portion (40), a first engaging portion (42), a contact portion (38) and a free end (36). Each of the assistant contacts includes a retaining portion (50), a second engaging portion (46) and a bearing portion (52). The bearing portions extend vertically from the second engaging portions and floatingly engage with corresponding free ends of the main contacts during mating.

7 Claims, 5 Drawing Sheets

ELECTRICAL CONNECTOR HAVING IMPROVED FEATURES REGARDING NORMAL FORCE REQUIRED FOR EFFECTIVELY ENGAGING A PRINTED BOARD WITH THE ELECTRICAL CONNECTOR

BACKGROUND OF THE INVENTION

1. Field of the Invention

The present invention relates to an electrical connector, and particularly to an electrical connector for engaging with a printed circuit board which is oriented in a horizontal aspect, wherein a force for effecting a connection between the connector and the board can be controlled in a required range.

2. Description of Related Art

Referring to FIGS. 8 and 9, a conventional electrical connector 7 is shown to interconnect a first printed circuit board (PCB) 8 arranged in a horizontal aspect and a second printed circuit board 9 arranged in a vertical aspect. The electrical connector 7 comprises a dielectric housing 70 and a plurality of terminals received in the dielectric housing 70. The terminals are divided into first terminals 72, and second terminals 74 which generally perform mechanical counterbalance function rather than electrical transmission one, wherein the first terminals 72 extend out of upper and bottom surfaces of the dielectric housing 70, and the second terminals 74 extend out of the bottom surface of the dielectric housing 70. The first PCB 8 has a bottom of face engaging with an arced top portion of each the first terminals 72 by a depressing normal force $F_0$ acting on the PCB 8. The second PCB 9 is inserted between lower parts of the first and second terminals 72, 74 extending beyond the bottom surface of the housing 70.

A relation between a downward displacement of the first PCB 8 and the depressing normal force $F_0$ is shown in FIG. 9, in which the displacement of the PCB 8 equals to a downward displacement of the first terminals 72, and the depressing normal force $F_0$ equals to a generated reaction force of the fist terminals 72. From FIG. 9, it can be seen that for the conventional connector, the required depressing normal force $F_0$ needs to steeply increase between the requirement minimal and maximal displacements D1, D2 of the first printed circuit board 8. The steep increase of the required depressing normal force $F_0$ can result in a short life of use of the connector 7. Hence, an improved electrical connector is required to overcome the disadvantages of the prior art.

SUMMARY OF THE INVENTION

Accordingly, the object of the present invention is to provide an electrical connector which controls normal force required for effectively engaging a PCB in a required range, in other words, regarding a definite displacement of contacts arranged in the electrical connector, the normal force only increases slightly in comparison with the prior art.

In order to achieve the object set forth, an electrical connector is adapted for connecting two PCBs disposed vertical to each other, includes an insulative housing, a plurality of main contacts and assistant contacts. The insulative housing has a lateral wall, a plurality of sidewalls extending from the lateral wall and a plurality of cavities formed between each two adjacent sidewalls. The insulative housing further defines an upper surface and a bottom surface. The main contacts are received in the insulative housing and project upwardly from the upper surface and downwardly from the bottom surface of the housing. Each of the main contacts has a first engaging portion engaging with the housing, and a curved contact portion projecting upwardly beyond the upper surface. The curved contact portion further has a free end in the housing. The assistant contacts are received in the housing, each of which includes a second engaging portion for engaging with the housing and a downwardly slanted bearing portion. The bearing portion engages with the free end of the main contact when a normal force depressed on the contact portion of the main contact.

Other objects, advantages and novel features of the invention will become more apparent from the following detailed description when taken in conjunction with the accompanying drawings.

DETAILED DESCRIPTION OF THE INVENTION

Figure 1:
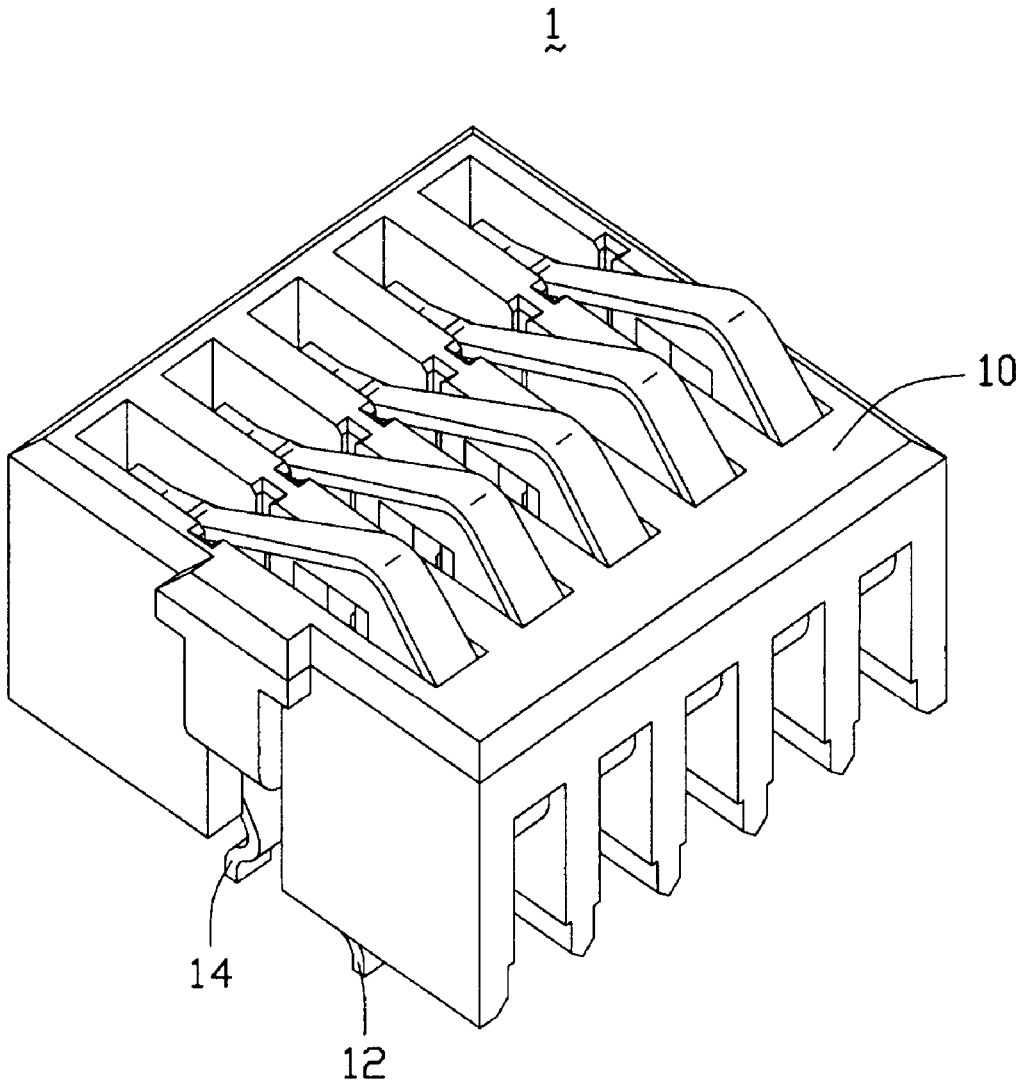
FIG. 1 is a perspective view of an electrical connector in accordance with the present invention.
Figure 2:
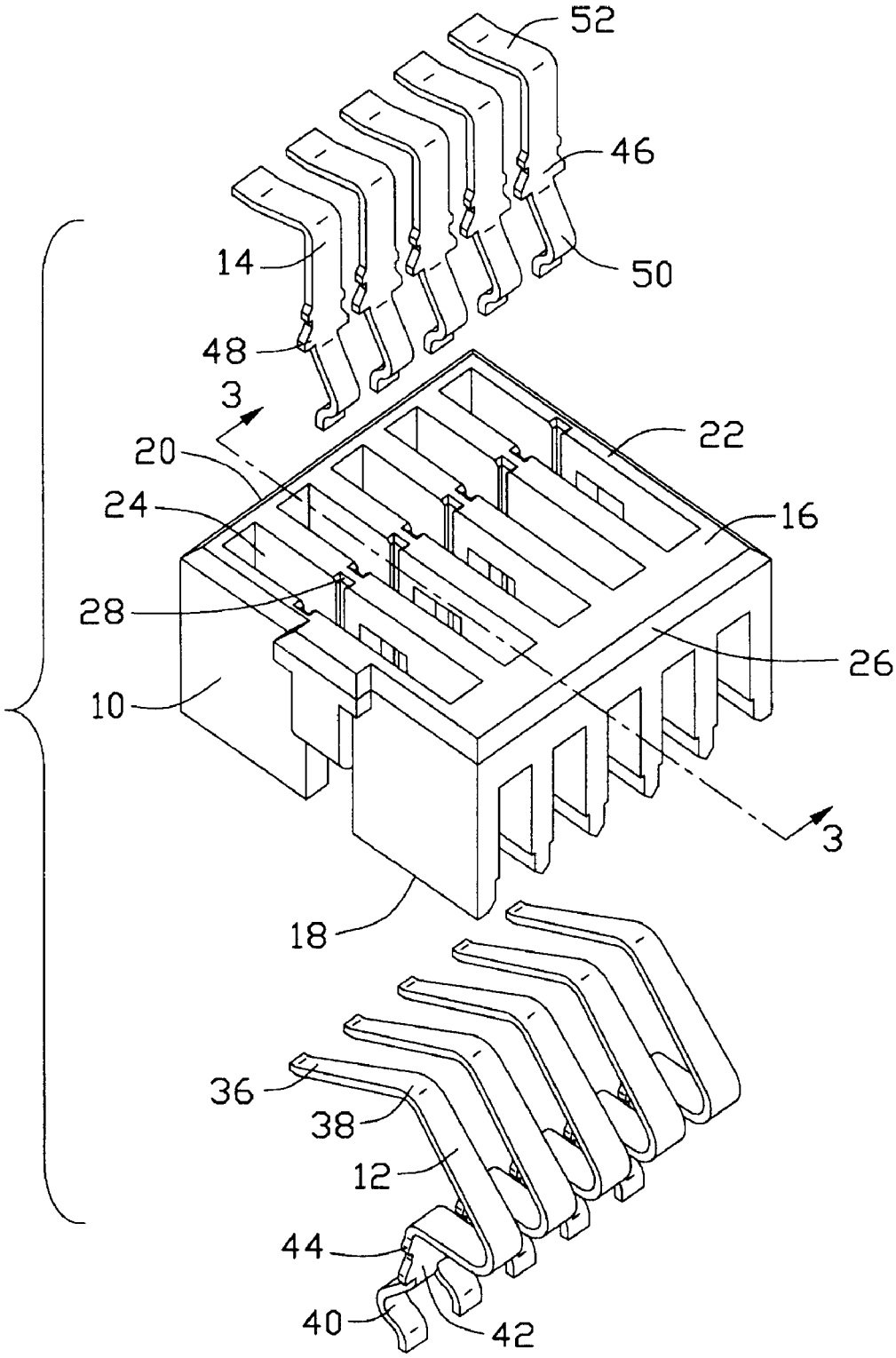
FIG. 2 is an exploded view of the electrical connector shown in FIG. 1.

Referring to FIGS. 1 and 2, an electrical connector 1 of the present invention is useful for interconnecting two PCBs 3 and 5 (shown in FIG. 4), in which the PCB 3 horizontally connects with the connector 1 and the PCB 5 vertically connects with the connector 1. The electrical connector 1 comprises an insulative housing 10, and a line of main contacts 12 and a line of assistant contacts 14 which are both received in the insulative housing 10 and located generally at respectively opposite sides of the insulative housing 10. The insulative housing 10 has a top surface 16 which is arranged to confront the PCB 3 and extends parallel to the PCB 3, and a bottom surface 18 which is perpendicular to the PCB 5.

The insulative housing 10 has a lateral wall 20, and a plurality of sidewalls 22 extending from the lateral wall 20 and disposed parallel to one another, wherein the lateral wall 20 and two outermost sidewalls 22 cooperatively define a circumferential frame of the insulative housing 10, and a plurality of cavities 24 is defined between each two adjacent sidewalls 22. The cavities 24 are arranged in a line to the line of main contacts 12 and assistant contacts 14. A beam 26 connects upper corners of the sidewall 22 together, wherein the corners are remote from the lateral wall 20. The sidewalls 22, except the outermost ones, each have two vertically extending recesses 28 in opposite faces thereof, while the two outermost sidewalls 22 each have a vertically extending recess 28 in an inner face thereof.

Each of the main contacts 12 comprises an upper part with a free end (an abutment portion) 36 and a curved contact portion 38, and a lower part that serves as a mounting leg for mounting the electrical connector 1 to the PCB 5, wherein the lower part is substantially vertically extended downward from the upper part. The lower part defines a retaining portion 40 and an engaging portion 42 having pairs of teeth 44 for having an interferential engagement with the housing 10. The upper part is gradually narrower from the contact portion 38 toward the free end 36, and the contact portion 38 has a width smaller than that of the engaging portion 42, whereby the main contacts 12 can securely mounted in the housing 10 while the upper parts of the main contacts 12 are deflected when a depressing normal force acts thereon. The free end 36 is formed with a slightly curved configuration thereby providing a smooth engagement between the free end 36 and the assistant contact 44.

With reference to FIG. 2 again, the assistant contact 14 has an engaging portion 46 with pairs of teeth 48, a retaining portion 50 extending from the engaging portion 46, and a bearing portion 52 extending from a top end of engaging portion 46. The bearing portion 52 is slanted downwardly.

Figure 3:
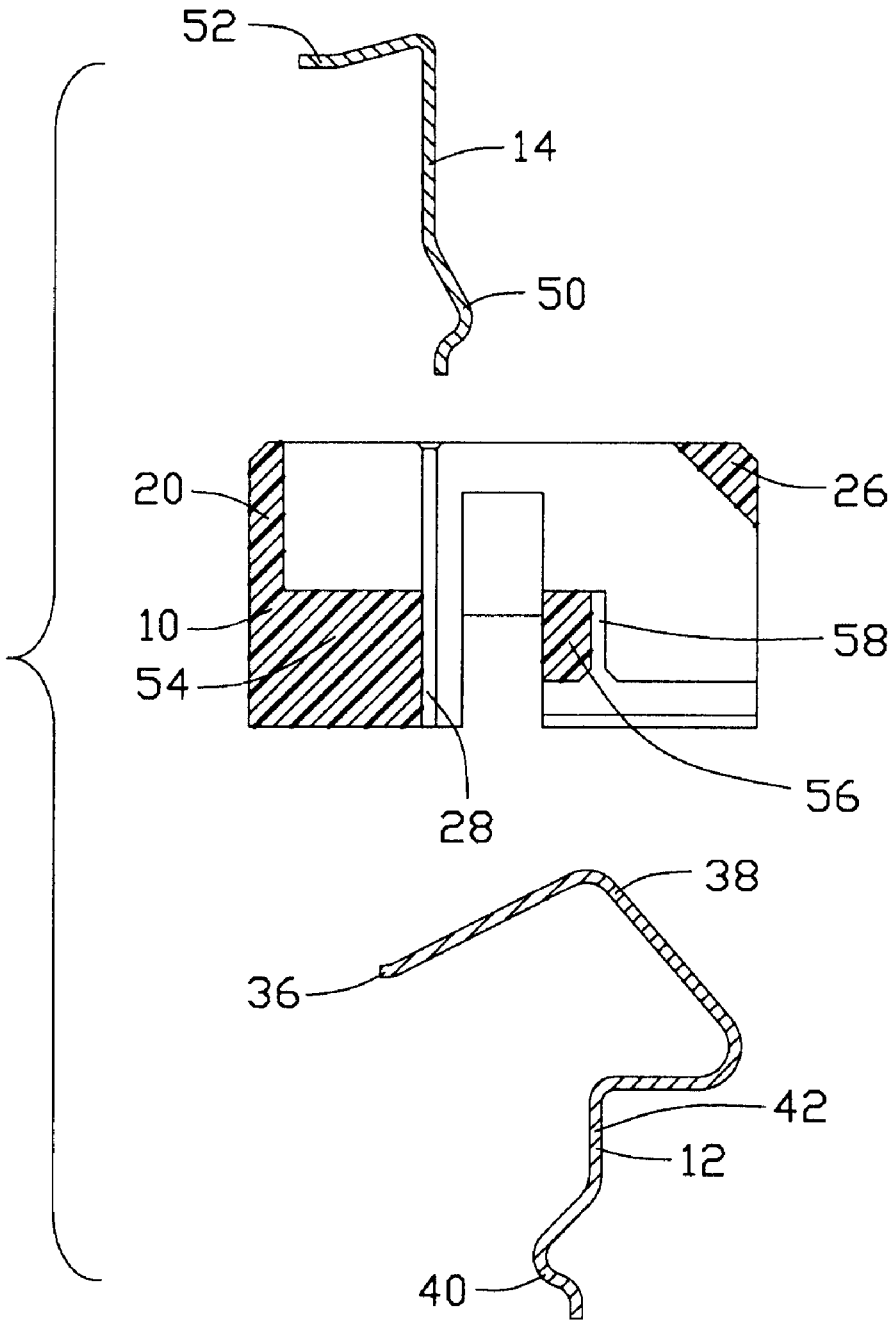
FIG. 3 is a cross-sectional view of the electrical connector taken along lines 3—3 of FIG. 2.

FIG. 3 illustrates the main contact 12 and assistant contact 14 assembled into the insulative housing 10. As shown, the housing 10 has a projection 54 extending horizontally and inwardly from a lower portion of the lateral wall 20 of the insulative housing 10. A plurality of ribs 56 each are located in a corresponding cavity 24 near a middle of the housing 10 and interconnect two adjacent sidewalls 22. A plurality of grooves 58 is formed in the sidewalls 22 in a manner like the recesses 28. Nevertheless, the groove 58 are located beside the ribs 56, respectively.

In assembly, the assistant contacts 14 are mounted into the cavities 24 at a position wherein the teeth 48 engage in the recesses 28, the retaining portions 50 extend downwardly beyond the bottom surface 18 of the housing 10, and the bearing portions 52 are located in the housing 10 above the projections 54 and inside of the sidewall 20. The main contacts 12 are mounted into the cavities 24 at a position generally opposite the assistant contacts 14 in respective to the middle of the housing 10, wherein the teeth 44 engage in the grooves 58, the contact portions 38 extend upward beyond the top face 16 of the housing 10, the retaining portions 40 extend downward beyond the bottom surface 18 and the free ends 36 extend to rest on the bearing portions 52 of the assistant contacts 14 as shown in FIG. 4.

Figure 4:
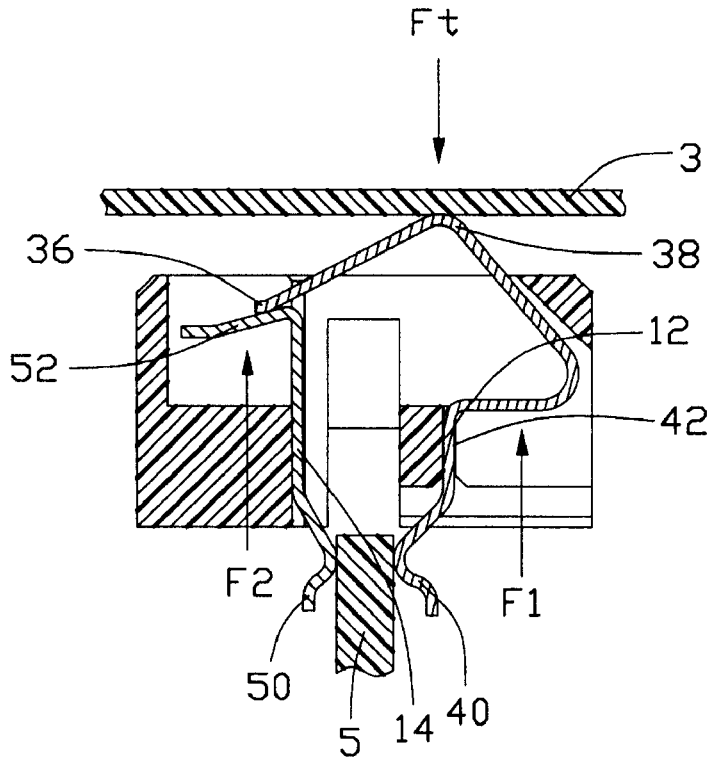
FIG. 4 shows a cross-sectional view of the electrical connector interconnecting two PCBs.

As shown in FIG. 4, the two PCBs 3, 5 are mounted to the electrical connector 1, wherein the contact portion 38 of the main contacts 12 engages with the PCB 3, and the retaining portions 40, 50 together clamp the PCB 5 therebetween. Each of the retaining portions 40, 50 has a curved configuration pointing toward each other so that the retaining portions 40, 50 can effect the clamping of the PCB 5 therebetween, which is vertically oriented relative to the bottom surface 18 of the housing 10.

Figure 5:
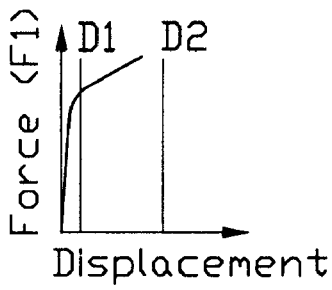
FIG. 5 is a diagram showing a relation between displacement and generated reaction force of a main contact of the electrical connector.
Figure 6:
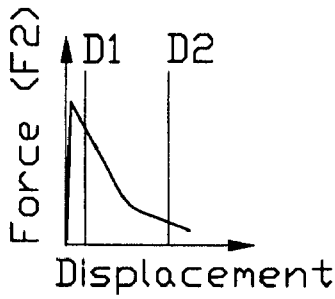
FIG. 6 is a diagram showing a relation between displacement and generated reaction force of an assistant contact of the electrical connector.
Figure 7:
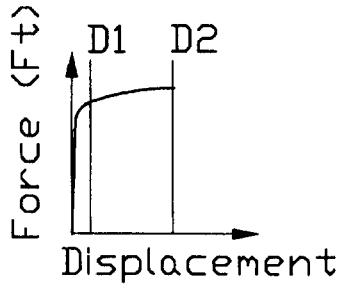
FIG. 7 is a diagram showing a relation between displacement of an upper PCB and normal force acting on the upper PCB.
Figure 8:
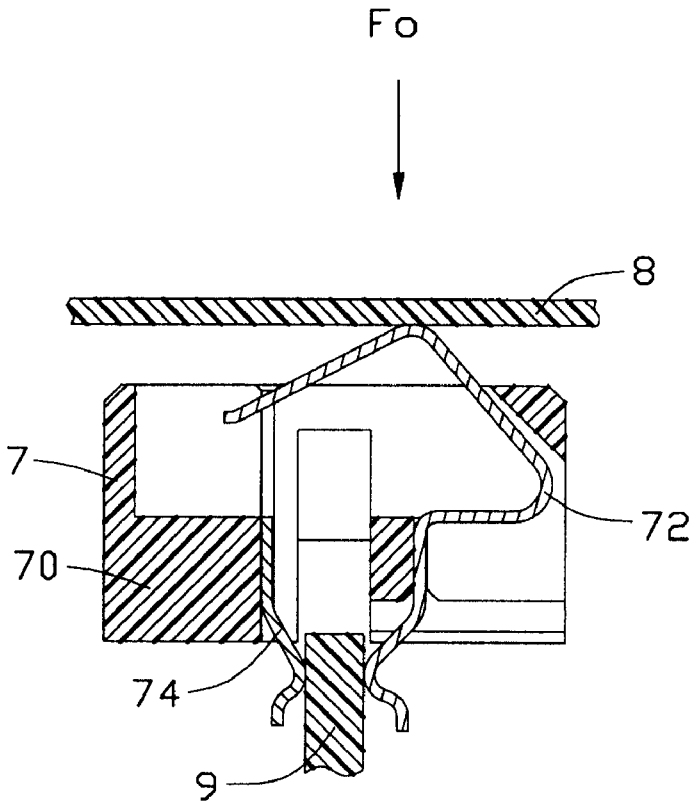
FIG. 8 (PRIOR ART)
FIG. 8 is a cross-sectional view showing a conventional electrical connector interconnecting two PCBs.
Figure 9:
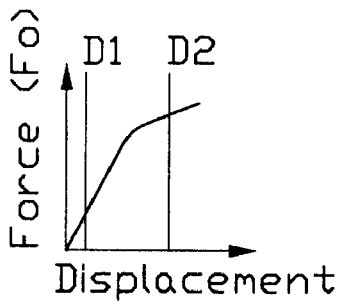
FIG. 9 (PRIOR ART)
FIG. 9 is a diagram showing a relation between displacement of an upper PCB of FIG. 7 and normal force acting on the upper PCB.

The PCB 3 engages with the contact portions 38 of the main contacts 12 by a depressing normal force Ft acting on the PCB 3. The normal force Ft causes the main contacts 12 to generate a reaction force F1 and the assistant contacts 14 to generate a reaction force F2. The PCB 3 is required to have a minimal displacement D1 and a maximal displacement D2, between which the PCB 3 can have an optimal electrical/mechanical engagement with the contact portions 38. Between the displacements D1, D2, the reaction force F1 is increased (FIG. 5) while the reaction force F2 (FIG. 6) is decreased due to a cooperating geometry of the fee ends 36 of the main contacts and the bearing portions 52 of the assistant contacts 14; thus, the depressing normal force Ft for moving the PCB 3 from the displacement D1 to the displacement D2, which is equal to a resultant force of the reaction forces F1, F2, only needs to increase slightly (FIG. 7) in comparison with the prior art (FIG. 8).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, in this embodiment the force transformation function is provided by the bearing portion 52 of the assistant contact 14 so that such a assistant contact 14 may perform both mechanical and electrical functions in comparison with the pure mechanical function thereof. Alternately, such force transformation function may be provided by the plastic piece without concerning electrical transmission between the main contact 12 and the assistant contact 14.

What is claimed is:

1. An electrical connector comprising:

an insulative housing having a lateral wall, a plurality of sidewalls extending from the lateral wall, and a plurality of cavities formed between two adjacent sidewalls, said insulative housing further defining an upper surface and a bottom surface;

a plurality of main contacts being mounted in the cavities of the insulative housing and projecting upwardly from the upper surface and downwardly from the bottom surface of the insulative housing, each of said main contacts having a first engaging portion engaging with the insulative housing, and a curved contact portion projecting upwardly beyond the upper surface and having a free end in the insulative housing; and a plurality of assistant contacts being also received in the cavities of the insulative housing, each assistant contact having a second engaging portion engaging with the insulative housing and a downwardly slanted bearing portion, said bearing portion engaging with the free end of the contact portion of the main contact when a force depresses the contact portion of the main contact.

2. The electrical connector as described in claim 1, wherein the insulative housing comprises two arrays of recesses in the sidewalls, and both first and second engaging portion are located in the recesses.

3. The electrical connector as described in claim 2, wherein each main contact defines a resilient structure between the contact portion and the engaging portion.

4. The electrical connector as described in claim 3, wherein both the main contacts and the assistant contacts are located at opposite sides of the housing, and each contact have a retaining portion extending downwardly out of the bottom surface of the housing for clamping a board therebetween.

5. An electrical connector assembly comprising:

an insulative housing defining a surface thereon;

a plurality of cavities disposed in the housing;

a plurality of main contacts received in the corresponding cavities, respectively, each of said main contacts having a contact portion extending out of the surface and an abutment portion extending from said contact portion; and bearing portions located in the cavities opposite to the corresponding main contacts, respectively; and each of said bearing portions being configured/characterized to cooperate with the abutment portions; wherein when the contact portion is moved back, by a depressing normal force from an external electronic device, in a direction from the surface to the cavity, the abutment portion first engages the bearing portion and successively moves along said bearing portion under a condition that the depressing normal force is substantially smoothly and slightly increased between a predetermine required minimum/maximum displacement range of said electronic device relative to said housing, the bearing portion being flexible in a direction along said depressing normal force.

6. The assembly as described in claim 5, wherein said bearing portion generates a large reaction force at a beginning engagement with the abutment portion while a smaller reaction force after said beginning engagement.

7. The assembly as described in claim 5, wherein said bearing portion is a portion of an assistant contact which cooperates with the corresponding main contact to sandwich a printed circuit board therebetween around a portion of the housing opposite to said surface.

* * * * *